US006388537B1

(12) United States Patent
Matsumoto

(10) Patent No.: US 6,388,537 B1
(45) Date of Patent: May 14, 2002

(54) ANTENNA FEEDING SYSTEM

(75) Inventor: Soichi Matsumoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/453,963

(22) Filed: Dec. 3, 1999

(30) Foreign Application Priority Data

Jun. 2, 1999 (JP) ..... 11-154809

(51) Int. Cl.[7] ..... H01P 1/16; H01P 5/12

(52) U.S. Cl. ..... 333/21 A; 333/125; 333/135

(58) Field of Search ..... 333/21 A, 21 R, 333/121, 125, 122, 127, 135, 137, 132, 133; 343/786, 756, 772; 342/366; 455/63

(56) References Cited

U.S. PATENT DOCUMENTS 4,308,541 A * 12/1981 Seidel et al. ..... 343/786
H370 H * 11/1987 Gold ..... 333/113

* cited by examiner

*Primary Examiner*—Robert Pascal
*Assistant Examiner*—Kimberly E Glenn
(74) *Attorney, Agent, or Firm*—Rothwell, Figg, Ernst & Manbeck

(57) ABSTRACT

In order to receive simultaneously signals with different polarizations, the antenna feeding system is adapted to comprise diplexers and a hybrid circuit for synthesizing signals, which are transmitted through signal paths allocated to the frequency of a circularly polarized wave from the diplexers, upon giving 90° phase difference therebetween and for selectively outputting the synthesized signal to either one of signal terminal for right handed circularly polarized wave or for left handed circularly polarized wave.

5 Claims, 9 Drawing Sheets

<FRE-QUENCY>
<POLARI-ZATION>
V/R
f2
TERMINAL 6b
H/L
TERMINAL 7b
f2
V/R
TERMINAL 6a
f1
H/L
TERMINAL 7a
f1
10
10a
10b
10c
10d
11
11a
11b
11c
11d
9
9
(V)
(H)
(R)
(L)
HYBRID CIRCUIT
HYBRID CIRCUIT
STATE B
STATE A
ORTHOMODE TRANSDUCER
ORTHOMODE TRANSDUCER
DIPLEXER
DIPLEXER
4a
4b
5a
5b
3
3
1
180° POLARIZER
ROTATION

<FREQUENCY>
<POLARIZATION>
f1
V
TERMINAL 6a
TERMINAL 6b
f2
R
f2
L
TERMINAL 7b
f1
H
TERMINAL 7a
ORTHO-MODE TRANSDUCER
4e
90° POLARIZER
2
ORTHO-MODE TRANSDUCER
4d
ORTHO-MODE TRANSDUCER
4c
(f2)
(f1)
DIPLEXER
5a
4b
ORTHO-MODE TRANSDUCER
(H)
DIPLEXER
5b
1a
1b
ORTHO-MODE TRANSDUCER
(V)
4a
3
180° POLARIZER
1
ROTATION
3

FIG. 8 (a)

| f1 | f2 | |
|---|---|---|
| CIRCULAR | CIRCULAR | x |
| CIRCULAR | LINEAR | x |
| LINEAR | CIRCULAR | O |
| LINEAR | LINEAR | x |

FIG. 8 (b)

| f1 | f2 | |
|---|---|---|
| CIRCULAR | CIRCULAR | x |
| CIRCULAR | LINEAR | x |
| LINEAR | CIRCULAR | O |
| LINEAR | LINEAR | O |

FIG. 8 (c)

| f1 | f2 | |
|---|---|---|
| CIRCULAR | CIRCULAR | O |
| CIRCULAR | LINEAR | O |
| LINEAR | CIRCULAR | O |
| LINEAR | LINEAR | O |

FIG. 8 (d)

| f1 | f2 | |
|---|---|---|
| CIRCULAR | CIRCULAR | O |
| CIRCULAR | LINEAR | x |
| LINEAR | CIRCULAR | x |
| LINEAR | LINEAR | O |

ANTENNA FEEDING SYSTEM

BACKGROUND OF THE INVENTION

1. Field of the Invention

The present invention relates to an antenna feeding system installed at a station such as an earth station for tracking and controlling an artificial satellite hereinafter referred to as a satellite, particularly relates to an antenna feeding system for shared application of a circularly polarized wave and a linearly polarized wave.

2. Description of the Prior Art

FIG. 9 is a block diagram for a conventional antenna feeding system. 1 is a 180° polarizer for rotating the plane of polarization of a linearly polarized wane signal transmitted from a satellite, 2 is a 90° polarizer for passing through the signal transmitted from the satellite leaving as it is when the wave is linearly polarized and for resolving the signal into perpendicularly intersecting two linearly polarized waves when the wave is circularly polarized, 3 is a rotary joint for rotating the 180° polarizer 1 and the 90° polarizer 2, respectively, 4 is an orthomode transducer for dividing the perpendicularly intersecting two waves to each wave, 5 is a diplexer for dividing a signal consisting of signals having different frequencies and 6*a*, 6*b*, 7*a*, and 7*b* are signal terminals for outputting signals with respective polarization and respective frequency among different polarizations and frequencies.

A description on a conventional antenna feeding system will be given. By means of the rotary joint 3, the 90° polarizer 2 is coupled rotatably with the 180° polarizer 1 and with the orthomode transducer 4, and the 90° polarizer 2 is capable of setting an arbitrarily chosen angle with respect to the orthogonally intersecting polarized wave terminals of the orthomode transducers 4. Within the 90° polarizer 2, a dielectric plate is disposed and the angle of this dielectric plate with respect to the orthomode transducer 4 becomes a setting angle of the 90° polarizer 2. As to the orthomode transducer 4, two transducers of 4*a* and 4*b* are disposed on the output side of the 90° polarizer 2, and these transducers 4*a* and 4*b* have orthogonally polarized wave terminals, respectively. The diplexers 5*a* and 5*b* are connected with the orthomode transducers 4*a* and 4*b* and the signals processed in the diplexers 5*a* and 5*b* are arranged to be outputted to the signal terminals 6*a*, 6*b*, 7*a* and 7*b*. To these terminals 6*a*, 6*b*, 7*a* and 7*b*, frequency and polarization of input and output signals are allocated and respective signals, whose frequency and polarization are coincident with allocated ones, are inputted or outputted.

Subsequently, an operation of the conventional antenna feeding system for receiving a signal from a satellite will be described with reference to FIG. 9. Concretely, at first operation of receiving circularly polarized wave signals having frequencies of f1 and f2 and then receiving linearly polarized wave signals having frequencies of f1 and f2 will be described.

Now, the linearly polarized wave is the one having a polarization whose direction of propagation of an electric field is directed to a constant direction, and there exists orthogonally intersecting linearly polarized waves such as a vertically polarized wave V and a horizontally polarized wave H; the electromagnetic wave having orthogonally intersecting planes of polarization such as a vertically polarized wave V and a horizontally polarized wave can be utilized for transmission of different information by treating those waves as independent waves even when the frequencies are identical, and thus the reclamation of frequencies utilizing the orthogonally polarized wave becomes feasible. The circularly polarized wave is the one which is composed of a horizontally polarized wave H and a vertically polarized wave V with mutual phase difference of 90°, and depending on lag or lead of the phase difference, the circularly polarized wave becomes either a right handed circularly polarized wave R or a left handed circularly polarized wave L. Planes of the polarization of these waves rotate with period of the carrier wave clockwisely or counter-clockwisely and those waves intersect perpendicularly capable of carrying different information as independent electromagnetic waves, respectively.

Next, a description will be given on the operation of the antenna feeding system when it receives circularly polarized waves having frequencies of f1 and f2 transmitted from a satellite. Rotate the 90° polarizer 2 by the rotary joint 3 and set the dielectric plate within the 90° polarizer 2 so that the plate makes an angle of 45° with respect to the orthogonally intersecting polarized wave terminals of the orthomode transducers 4*a* and 4*b*. For receiving a circularly polarized wave, the 180° polarizer 1 can be set to an arbitrarily chosen position. The circularly polarized wave transmitted from a satellite is inputted to the 90° polarizer 2 through the 180° polarizer 1. When the circularly polarized wave inputted to the 90° polarizer 2 is right handed R, upon converting the right handed circular wave R to a vertically polarized wave V, it is outputted to the orthomode transducer 4*a*, and is transmitted to the diplexer 5*a* together with its energy.

On the other hand, when the circularly polarized wave inputted to the 90° polarizer 2 is left handed wave L, this wave is converted to a horizontally polarized wave H and is outputted to the orthomode transducer 4*b* though the orthomode transducer 4*a* and transmitted to the diplexer 5*b* together with its energy.

Through procession of the 90° polarizer 2, the incoming circularly polarized wave is identified as to whether the wave is right handed circularly polarized wave or left handed one.

The diplexer 5*a* and 5*b* perform procession of dividing the vertically polarized wave V and the horizontally polarized wave H with respect to the frequency, and divided signals through diplexers 5*a* and 5*b* are outputted to the signal terminal 6*a*, 6*b*, 7*a* and 7*b*: if the incoming signal is the right handed circularly polarized wave R with frequency of f1, the signal is outputted to the terminal 6*a* and if the signal is left handed circularly polarized wave L with a frequency of f2, the signal is outputted to the terminal 7*a*.

Likewise if the incoming signal is right handed circularly polarized wave R with a frequency of $f_2$, the signal is outputted to the terminal 6*b* and if the incoming signal is left handed L with a frequency of $f_2$, the signal is outputted to the terminal 7*b*. In this way, the incoming signal can be drawn through an appropriate terminal depending on the frequency and polarization of the incoming wave.

Next, operation on reception of linearly polarized waves having frequencies of $f_1$ and $f_2$ will be described.

Rotate the 180° polarizer 1 by means of the rotary joint 3 and set the dielectric plate within the 180° polarizer 1 so that the angular position becomes one corresponding to the angular position of the plane of the receiving linearly polarized wave. Concretely, when the plane of the polarization of the incoming wave makes an angle a with respect to the vertical axis, the dielectric plate within the 180° polarizer is positioned so that it makes angle of a, and the 90° polarizer 2 is set so that the dielectric plate within it makes angle of 0° or 90° with respect to the orthogonally intersecting polarized wave terminals of the orthomode transducers 4*a* and 4*b*. For reception of a linearly polarized wave, the 90° polarizer 2 can allow the linearly polarized wave passing through untouched by setting the 90° polarizer 2 to 0° or 90°.

A linearly polarized wave transmitted from a satellite is inputted to the 180° polarizer 1 and is converted so that the polarization plane becomes either vertical or horizontal.

Thus converted linearly polarized wave through the 180° polarizer 1 passes through the 90° polarizer 2 as is and is inputted to the orthomode transducers 4*a* and 4*b*. When the inputted linearly polarized wave is a vertically polarized wave V, it is divided through the orthomode transducer 4*a* and when that wave is a horizontally polarized wave H, it is divided through the transducer 4*b*. The vertically polarized wave signal V and the horizontally polarized wave signal H divided through the orthomode transducers 4*a* and 4*b*, respectively are transmitted to the diplexers 5*a* and 5*b*, respectively.

Processions of those vertically polarized wave signals V and the horizontally polarized wave signals H after being inputted to the diplexers 5*a* and 5*b* are the same as that of reception of the circularly polarized wave.

FIG. 8 shows a combination of polarizations capable of simultaneous reception of signals with different frequencies. A conventional antenna feeding system is capable of, as shown by FIG. 8 (a), simultaneous reception of circularly polarized waves with frequencies of f1 and f2 or those of linearly polarized waves with frequencies of f1 and f2. The unit for switching the reception mode for simultaneous reception of circularly polarized waves with frequencies of f1 and f2 and for those of linearly polarized waves with frequencies of f1 and f2 is simply the 90° polarizer 2; a conventional antenna feeding system performs mode switching for allowing a simultaneous reception by setting the 90° polarizer 2 to 45° for reception of circularly polarized waves with frequencies of f1 and f2 and by setting it to 0° or 90° for reception of linearly polarized waves with frequencies of f1 and f2.

SUMMARY OF THE INVENTION

The conventional antenna feeding system gives rise to a problem such that simultaneous reception of differently polarized waves is impossible. The reason is that setting angle (of the dielectric plate) of the 90° polarizer is different depending on the polarized wave being circular or linear: conventional antenna feeding system, after the 90° polarizer is set to either one of its polarization modes, signals having different frequencies can be divided only from simultaneously received waves having the same polarization.

However, an antenna feeding system enabling simultaneous transmission/reception of signals with different polarization is urgently needed in order to solve the problem arising from the congested frequency band due a rising demand for utilizing the electromagnetic wave in future.

The present invention is made in order to solve the problem mentioned above.

The prime object of the invention is to provide an antenna feeding system enabling a simultaneous transmission/reception of wave signals having different frequencies of $f_1$ and $f_2$ with different polarization such as a circular polarization and a linear polarization.

Also the object of the present invention is to provide an antenna feeding system enabling to arbitrarily switching the combination of frequency and polarization allowing transmission/reception depending on a signal being applied to a predetermined communication system.

An antenna feeding system according to the present invention comprises orthomode transducers for resolving simultaneously received circularly polarized wave signal and linearly polarized wave signal into a vertically polarized wave signal and a horizontally polarized wave signal and for outputting each of said vertically polarized wave signal and the horizontally polarized wave signal with respect to each polarization, a first diplexer for dividing the vertically polarized wave signal outputted from said orthomode transducer with respect to frequency and for outputting said vertically polarized wave signal having the same frequency with that of the circularly polarized wave signal to a signal path, which is allocated to the frequency of circularly polarized wave signal, and for outputting said vertically polarized wave signal having the same frequency with that of said linearly polarized wave signal to a signal terminal provided for the vertically polarized wave signal, a second diplexer for dividing the horizontally polarized wave signal outputted from the orthomode transducer with respect to frequency and for outputting said horizontally polarized wave signal having the same frequency with that of the circularly polarized wave signal to a signal path, which is allocated to the frequency of said circularly polarized wave signal, and for outputting the horizontally polarized wave signal having the same frequency with that of the linearly polarized wave signal to a signal terminal provided for the horizontally polarized wave signal, and a hybrid circuit for synthesizing said signals transmitted from said first diplexer and the second diplexer through the signal paths, which are allocated to frequency of said circularly polarized wave signal, upon giving phase difference of ninety degrees between the signals and for outputting the synthesized signal selectively to either of a signal terminal provided for the right-handed circularly polarized wave signal or a signal terminal provided for the left-handed circularly polarized wave signal with respect to type of said circularly polarized wave signal.

In an antenna feeding system according to the present invention, selector switches, which perform switching destinations of output signals being divided by the first diplexer and the second diplexer between the hybrid circuit and the signal terminals, are disposed between the diplexers and the hybrid circuit.

In an antenna feeding system according to the present invention, with respect to the circularly polarized wave signal inputted into said orthomode transducers, the selector switches connect the signal paths being allocated to said frequency of the circularly polarized wave signal to the hybrid circuit so that signals outputted from the first diplexer and from said second diplexer are inputted to said hybrid circuit, and with respect to said linearly polarized wave signal inputted into said orthomode transducers, the selector switches connect said signal paths being allocated to said frequency of the linearly polarized wave to predetermined signal terminals so that signals outputted from the first diplexer and from the second diplexer are inputted to the signal terminals.

In an antenna feeding system according to the present invention, said hybrid circuit synthesizes signals being inputted through phase shifters for compensating phase difference of signals which are divided with respect to frequency by said first diplexer and the second diplexer.

An antenna feeding system according to the present invention, said hybrid circuit synthesizes signals being inputted through phase shifters for compensating phase difference of signals which are divided with respect to frequency by said first diplexer and the second diplexer.

A antenna feeding system according to the present invention comprises orthomode transducers for resolving simultaneously received circularly polarized wave signal and linearly polarized wave signal into a vertically polarized wave signal and a horizontally polarized wave signal and for outputting each of the vertically polarized wave signal and the horizontally polarized wave signal with respect to each polarization, a first diplexer for dividing the vertically polarized wave signal outputted from said orthomode transducer with respect to frequency and for outputting the vertically polarized wave signal having the same frequency with that of the circularly polarized wave signal to a signal path, which is allocated for the frequency of the circularly polarized wave signal, and for outputting the vertically polarized wave signal having the same frequency with that of said frequently polarized wave signal to a signal terminal provided for the vertically polarized wave signal, a second diplexer for dividing the horizontally polarized wave signal outputted from the orthomode transducer with respect to frequency and for outputting said horizontally polarized wave signal having the same frequency with that of the circularly polarized wave signal to a signal path, which is allocated to the frequency of said circularly polarized wave signal to a signal path, and for outputting the horizontally polarized wave signal having the same frequency with that of the linearly polarized wave signal to a signal terminal provided for the horizontally polarized wave signal terminal, and a first orthomode transducers being connected to said first diplexer and to the second diplexer through the signal paths being allocated to the frequency of the circularly polarized wave signal and for synthesizing the signals, which are transmitted through the paths from the diplexers, to a circularly polarized wave signal, a first 90° polarizer for outputting a vertically polarized wave signal when the circularly polarized signal transmitted from the first othromode transducer is right-handed, and for outputting a horizontally polarized wave signal when the circularly polarized wave signal transmitted from the first orthomode transducer in left-handed, and a second orthomode transducer for outputting a signal to a predetermined signal terminal depending on wave signal outputted form the 90° polarizer being vertically polarized or being horizontally polarized.

BRIEF DESCRIPTION OF DRAWINGS.

FIG. 8(*a*), FIG. 8(*b*), FIG. 8(*c*) and FIG. 8(*d*) are tables for illustrating combination of polarizations allowing simultaneous reception of signals having different frequencies.

DESCRIPTION OF THE PREFERRED EMBODIMENTS

Figure 1:
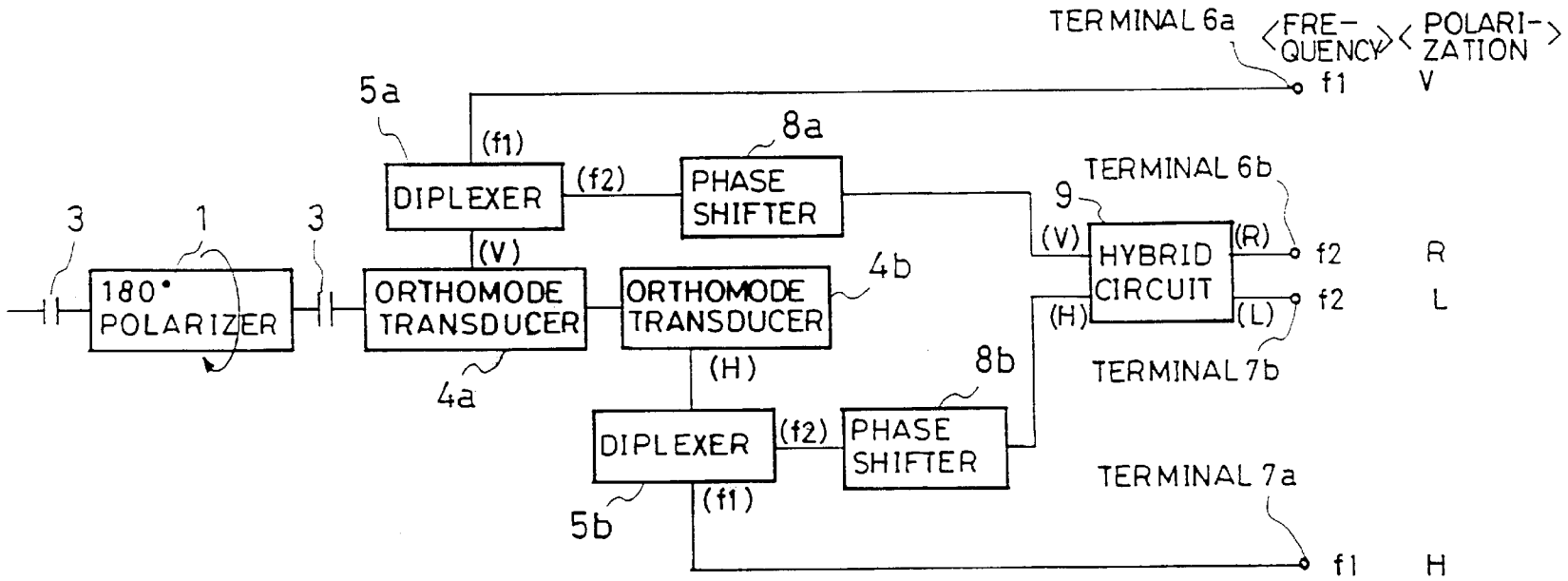
FIG. 1 is a block diagram of antenna feeding system according to the Embodiment 1 of the present invention.
Figure 2:
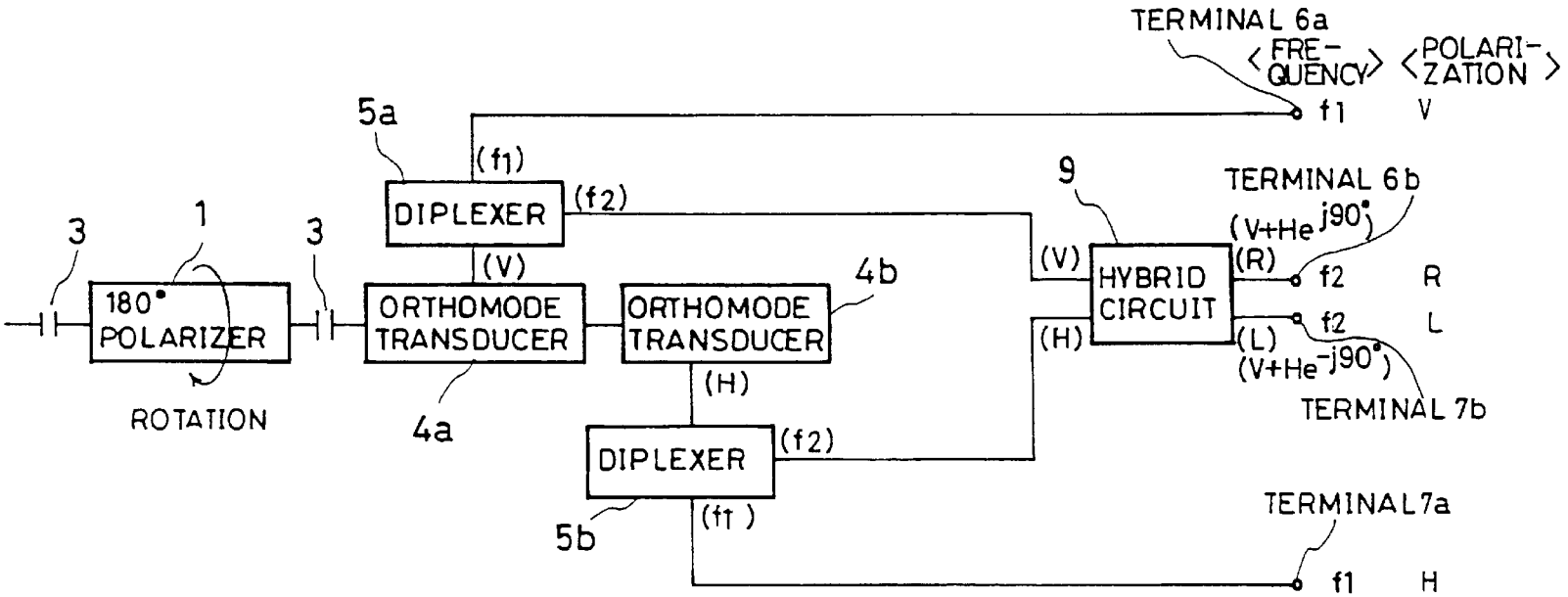
FIG. 2 is a block diagram of antenna feeding system according to the Embodiment 1 of the present invention.
Figure 3:
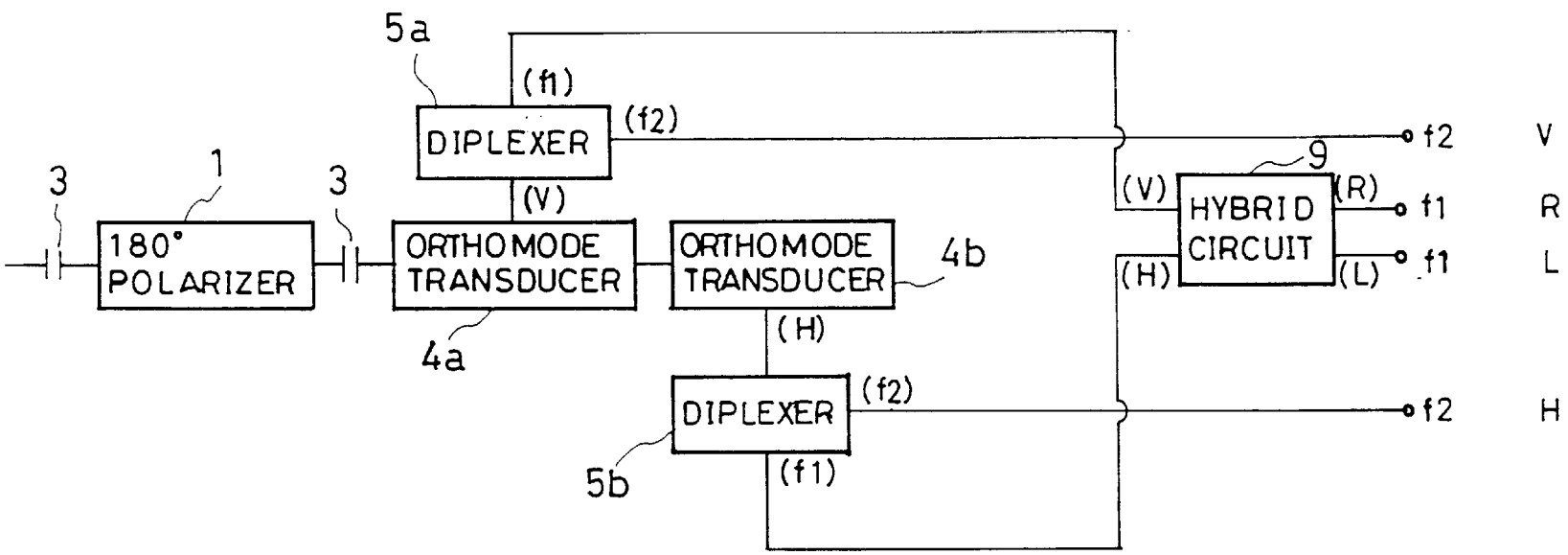
FIG. 3 is a block diagram of an example of a modified antenna feeding system according to the Embodiment 1 of the present invention.
Figure 9:
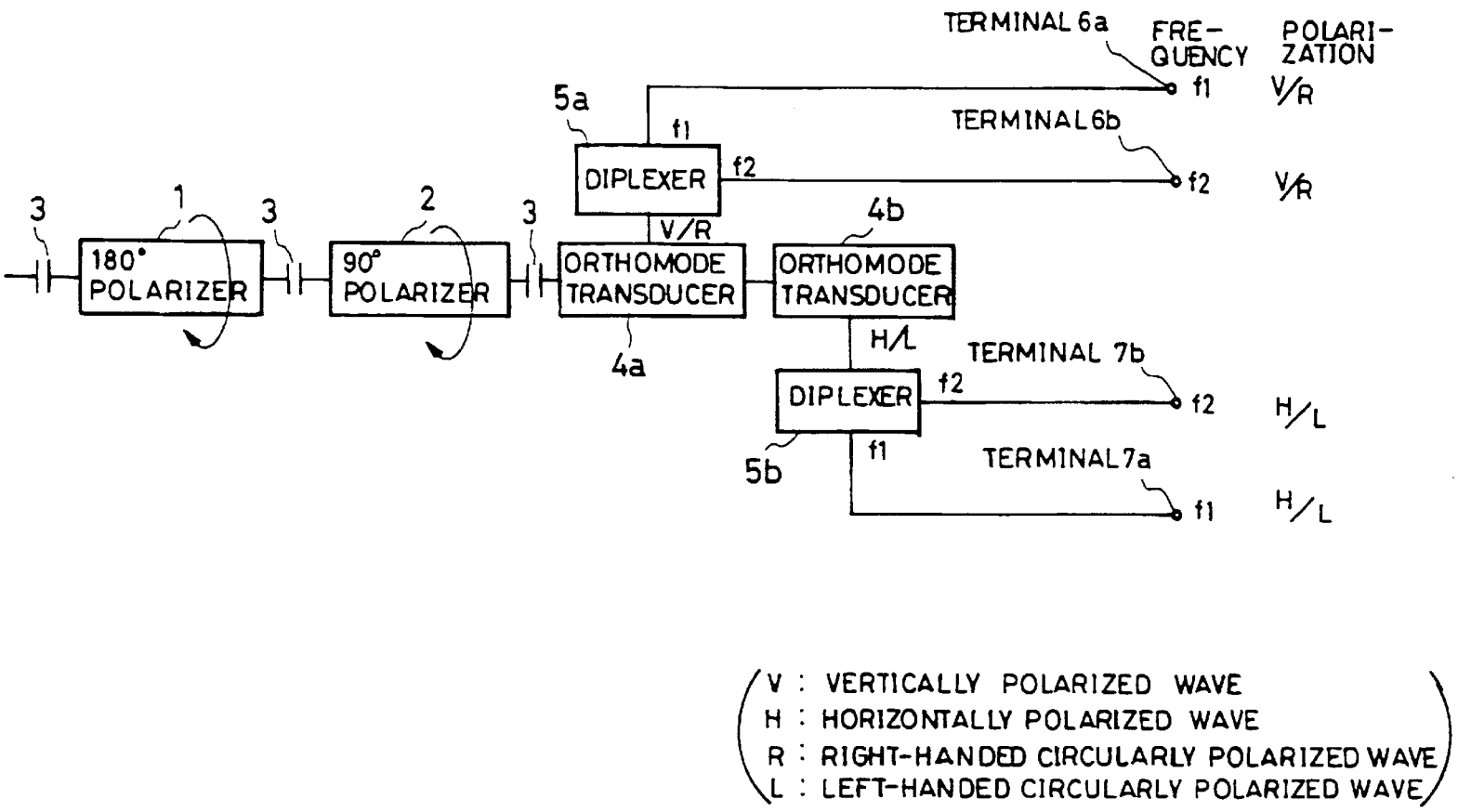
FIG. 9 PRIOR ART
FIG. 9 is a block diagram of a conventional antenna feeding system.

FIG. 1 and 2 are block diagrams showing the antenna feeding system according to the Embodiment 1 of the present invention and FIG. 3 is a block diagram showing a modified version of the Embodiment 1. In FIG. 1, 8*a* and 8*b* are phase shifters for compensating the phase difference between signals outputted from the diplexers 5*a* and 5*b*, and 9 is a hybrid circuit for synthesizing two perpendicularly intersecting signals upon giving phase difference of 90° between them. Now, since the same symbols in FIG. 1 and FIG. 2 with these in FIG. 9 refer to the same or corresponding matters, description on them are deleted. A description will be given on the arrangement of the antenna system according to the Embodiment 1 of the present invention. The 180° polarizer 1 in coupled rotatably to the orthomode transducer 4 by means of the rotary joint 3. A dielectric plate is disposed within the 180° polarizer 1 and the angle of the dielectric plate with respect to the orthogonally intersecting wave terminals of the orthomode transducers 4*a* and 4*b* becomes the setting angle of the 180° polarizer 1.

Description will be given on the operation of the antenna feeding system according to the Embodiment 1 for the reception of signals transmitted from a satellite with reference to FIG. 1. Concretely, among operations for reception of a linearly polarized wave signal with frequency of $f_1$ and a circularly polarized wave signal with frequency of $f_2$, the description will be started from the reception of a circularly polarized wave signal with $f_2$. The received circularly polarized wave signal is inputted to the orthomode transducers 4*a* and 4*b* through the 180° polarizer 1. The circularly polarized wave is the one which is composed of a horizontally polarized wave H and a vertically polarized wave having identical amplitudes with a 90° phase difference, and depending on lead or lag of the phase between these waves, the circularly polarized wave becomes to be right handed R or left handed L. The circularly polarized wave signal inputted to the orthomode transducers 4*a* and 4*b* are resolved to a vertically polarized wave signal V and a horizontally polarized wave signal H and energies of these signals are, sharing equally by a half respectively, transmitted to the diplexers 5*a* and 5*b* from terminals of the orthomode transducers 4*a* and 4*b*, and these vertically and horizontally polarized wave signals V and H have a mutual phase difference of 90°.

The diplexers 5*a* and 5*b* divide the vertically polarized wave signal V and the horizontally polarized wave signal H inputted from the orthomode transducers 4*a* and 4*b* with respect to frequency. Since the frequency of received circularly polarized wave signal is $f_2$, divided signal is outputted to the phase shifters 8*a* and 8*b*.

Those shifters 8*a* and 8*b* compensate signals outputted from diplexers 5*a* and 5*b* so that their phase difference becomes just 90°, and they output thus compensated signals to the hybrid circuit 9. The hybrid circuit 9 synthesizes the signals, whose phase difference is already compensated to become 90°, and outputs signal to the signal terminal 6*b* or to 7*b* depending on the circularly polarized wave signal being right handed R or left handed L, respectively. In this way, the hybrid circuit 9 outputs signal to an appropriate terminal depending on type of the circularly polarized wave.

Next, operations of reception of a linearly polarized wave signal with frequency $f_1$ and a circularly polarized wave signal with frequency $f_2$ will be described. The 180° polarizer 1 is brought to be rotated by the rotary joint 3 and the dielectric plate within the 1800 polarizer 1 is set so that it makes an angle corresponding to the plane of polarization of a linearly polarized wave to be received. Concretely, when the polarization plane makes an angle of $\alpha$ with respect to the vertical axis, the dielectric plate disposed within the 180° polarizer 1 is set to make an angle of $\alpha/2$.

The linearly polarized wave transmitted from a satellite is inputted to the 180° polarizer 1 and is converted so that the polarzation plane becomes either vertical or horizontal The linearly polarized wave being converted through the 180° polarizer i is inputted to the orthomode transducer 4*a* and 4*b*. When the incoming linearly polarized wave is vertically polarized V, it is divided through the orthomode transducer 4*a* and when the wave is horizontally polarized H, it is divided through the orthomode transducer 4*b* and they are transmitted to diplexers 5*a* and 5*b*, respectively. Diplexers 5*a* and 5*b* divide the vertically polarized wave V and the horizontally polarized wave inputted from the orthomode transducers 4*a* and 4*b* with respect to frequency. Since the frequency of the received linearly polarized wave is $f_1$, the vertically polarized wave H and the horizontally polarized wave are outputted to the signal terminals 6*a* and 7*a*, respectively.

As aforementioned, since the antenna feeding system according to the present invention performs a synthesis of a circularly polarized wave through the hybrid circuit after performing resolution of the received signal and division with respect to frequency, simultaneous transmission/reception of a circularly polarized wave and a linearly polarized wave can be attained as shown by FIG. 8(*a*), and also the hybrid circuit is able to output a signal depending on the type of circularly polarized wave to a signal terminal being allocated depending on frequency and type of polarization of signal.

Also, it may happen that the property of orthogonality between both polarized waves is deviated because the vertically polarized wave and the horizontally polarized wave are subjected to different effects on respective phase shifts during the course of passing through the signal paths of the antenna feeding system. This deviation from the orthogonality may cause signal interference between both polarized waves resulting in an induction of a signal degradation. Thus, in the antenna feeding system according to the Embodiment 1 of the present invention, the phase shifters for compensation of phase difference between the received vertically polarized wave and the horizontally polarized wave are installed. By employing such elements, deviation from the orthogonality of both polarized waves can be prevented and signals with high quality of axes ratio can be drawn always and thus the quality of communication can be improved.

In the Embodiment 1, the antenna feeding system capable of receiving a linearly polarized wave signal with frequency $f_1$ and a circularly polarized wave signal with frequency $f_2$ transmitted from a satellite is described and yet, it is possible to have an antenna feeding system capable of a circularly polarized wave signal with frequency $f_1$ and a linearly polarized wave signal with frequency of $f_2$ by rearranging the system as shown by FIG. 3 In short, this antenna feeding system according to the present invention is characterized in a provision of a hybrid circuit which, after performing resolution of received circularly polarized wave signal through the orthomode transducers and performing division with respect to frequency through diplexers, composes a circularly polarized wave upon giving 90° phase difference between orthogonally intersecting two signals having identical amplitudes and which outputs signals to respective predetermined terminals depending on type of circularly polarized wave.

In the Embodiment 1, description on the reception of the signals with frequency $f_1$ and $f_2$ with different polarization respectively is given, and still the present invention can be applied to a transmission of signals with frequency $f_1$ and $f_2$ with different polarizations, to the transmission with frequency $f_1$ and reception with frequency $f_2$ and to the reception with frequency $f_1$ and transmission with frequency $f_2$.

Embodiment 2

Figure 4:
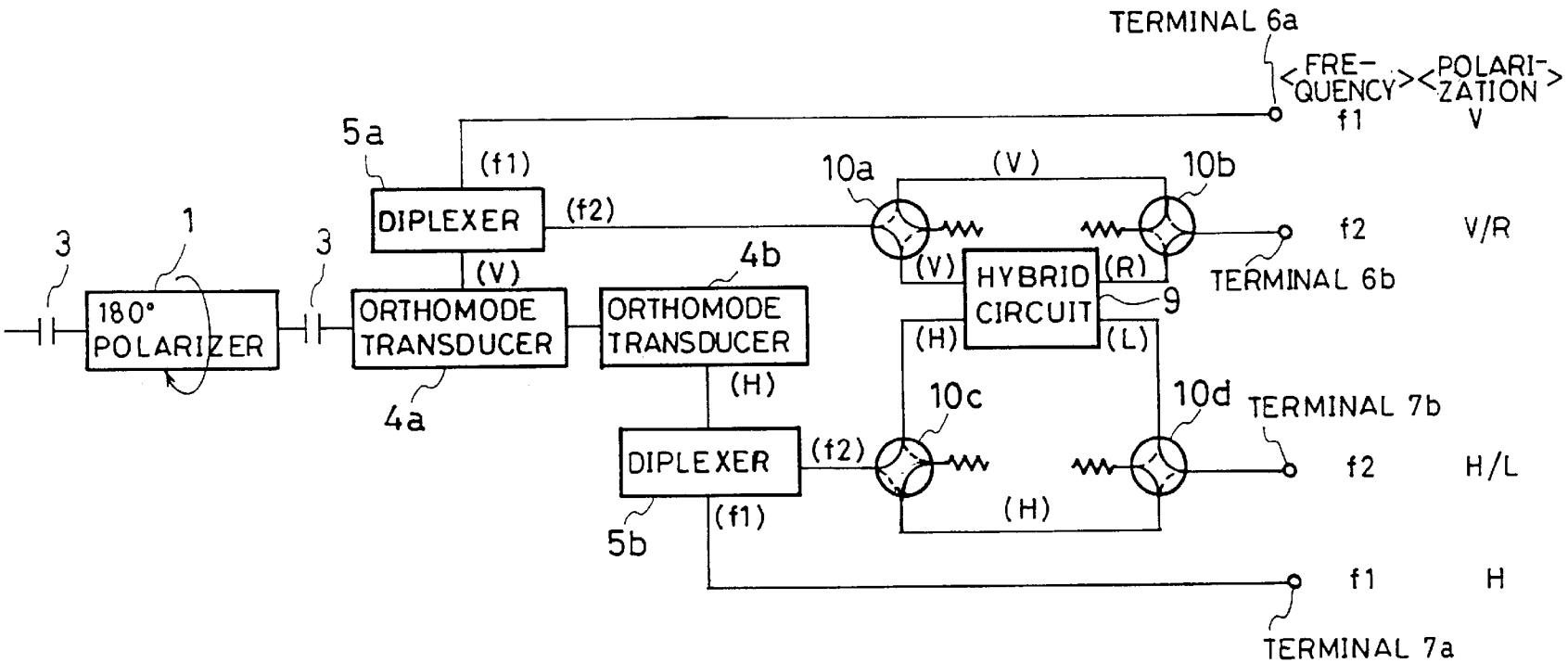
FIG. 4 is a block diagram of antenna feeding system according to the Embodiment 2 of the present invention.

In the Embodiment 1, description is given on the antenna feeding system capable of receiving a linearly polarized wave signal with frequency $f_1$ and a circularly polarized wave signal with frequency $f_2$. On the other hand, in the Embodiment 2 description on an antenna feeding system for selectively receiving a linearly polarized wave signal with frequency $f_1$ and a circularly polarized wave signed with frequency $f_2$ or receiving a linearly polarized wave signal $f_1$ and the same with frequency $f_2$ will be given. In FIG. 4, 10 is a selector switch 10 consists of 10*a* and 10*c* which are capable of switching selectively destination to be transmitted of signals being outputted from diplexers between the hybrid circuit 9 and signal terminals and consists of selector switches 10*b* and 10*d* which form signal paths to signal terminals depending on 10*a* and 10*b*. The same symbols in FIG. 4 with those in FIG. 1 refer to the same or corresponding matters, and therefore descriptions on them are deleted. Next, description will be given the operation of receiving a linearly polarized wave with frequency $f_1$ and a circularly polarized wave with frequency $f_2$. The linearly polarized wave signal with frequency $f_1$ is inputted to the 180° polarizer 1 being set to an angle corresponding to the polarization plane of the linearly polarized wave to be received and the 180° polarizer 1 converts the plane of the inputted linearly polarized wave to become vertical or horizontal and outputs thus converted signal to the orthomode transducers 4*a* and 4*b*.

The orthomode transducers 4*a* and 4*b* divide the linearly polarized wave, whose polarization plane is already converted to vertical or horizontal, to a vertically polarized wave or a horizontally polarized wave and thus divided waves through the orthomode transducers 4*a* and 4*b* are transmitted to the diplexers 5*a* and 5*b* and they are divided with respect to frequency.

Since the frequency of the linearly polarized wave is $f_1$, the vertically polarized wave V and the horizontally polarized H wave are outputted to signal terminals 6*a* and 7*a*, respectively.

Now, the circularly polarized wave signal with frequency $f_2$ is inputted to the orthomode transducers 4*a* and 4*b* through 180° polarizer 1 and the orthomode transducers 4*a* and 4*b* convert the inputted circularly polarized wave to the vertically polarized wave V and the horizontally polarized wave H and output them to diplexers 5*a* and 5*b*, respectively.

The selector switches 10*a* and 10*c* from signal paths between diplexers 5*a*, 5*b* and the hybrid circuit 9 so that the signals with frequency $f_2$ outputted from diplexers 5*a* and 5*b* are written into the hybrid circuit 9 and the signals outputted from diplexers 5*a* and 5*b* are written to the hybrid circuit 9 through signal paths being formed by the selector switches 10*a* and 10*c*. The hybrid circuit 9, after forming the circularly polarized wave by synthesizing inputted signals upon giving 90° phase difference, outputs the circularly polarized wave through the signal paths formed by the selector swatches 10*b* and 10*d* to the signal terminal 6*b* or to 7*b* depending on the circularly polarized wave being right handed R or left handed L, respectively.

Thus, the antenna feeding system according to the Embodiment 2 is capable of receiving a linearly polarized wave with frequency $f_1$ and a circularly polarized wave with frequency $f_2$.

Also by switching the selector switch 10, the antenna feeding system according to the Embodiment 2 is capable of receiving a linearly polarized wave with frequency $f_1$ and the same with frequency $f_2$. Now the description on the operation for receiving a linearly polarized wave with frequency $f_1$ will be deleted. The linearly polarized wave with frequency $f_2$ is inputted to the 180° polarizer 1 and after the wave is converted so that the polarization plane becomes to be vertical or horizontal, the converted wave is inputted to the orthomode transducers 4*a* and 4*b*, and those transducers 4*a* and 4*b* divide the inputted linearly polarized wave to the vertically polarized wave V and the horizontally polarized wave H. These divided waves are transmitted to the diplexers 5*a* and 5*b* and are divided with respect to frequency. Since the frequency of the received linearly polarized wave is $f_2$, signal must be outputted to respective signal terminals 6*b* and 7*b*. Then the selector switches 10*a*, 10*b*, 10*c* and 10*d* are switched to form signal paths so that signals outputted from the diplexers 5*a* and 5*b* are allowed to be outputted directly to the signal terminals 6*a* and 7*b*. Through these signal paths, the vertical polarized and horizontally polarized waves V and H are outputted to signal terminals 6*a* and 7*a*, respectively.

In this way, the selector switch 10 for selectively switching the destination of signal to be outputted is adapted to the antenna feeding system according to the Embodiment 2 of the present invention and by switching this selector switch 10, as shown by FIG. 8(*b*), either one of a reception mode for receiving a linearly polarized wave signal with frequency $f_1$ and a circularly polarized wave signal with frequency $f_2$ or a reception mode for receiving a linearly polarized wave signal with frequency $f_1$ and the same having frequency $f_2$ can be arbitrarily chosen. Furthermore by modifying circuit arrangement, also an arbitrary selection of either one of mode of receiving a circularly polarized wave signal with frequency $f_1$ and a linearly polarized wave signal with frequency $f_2$ or mode of receiving a linearly polarized wave signal with frequency $f_1$ and the same with frequency $f_2$ can be performed.

Figure 5:
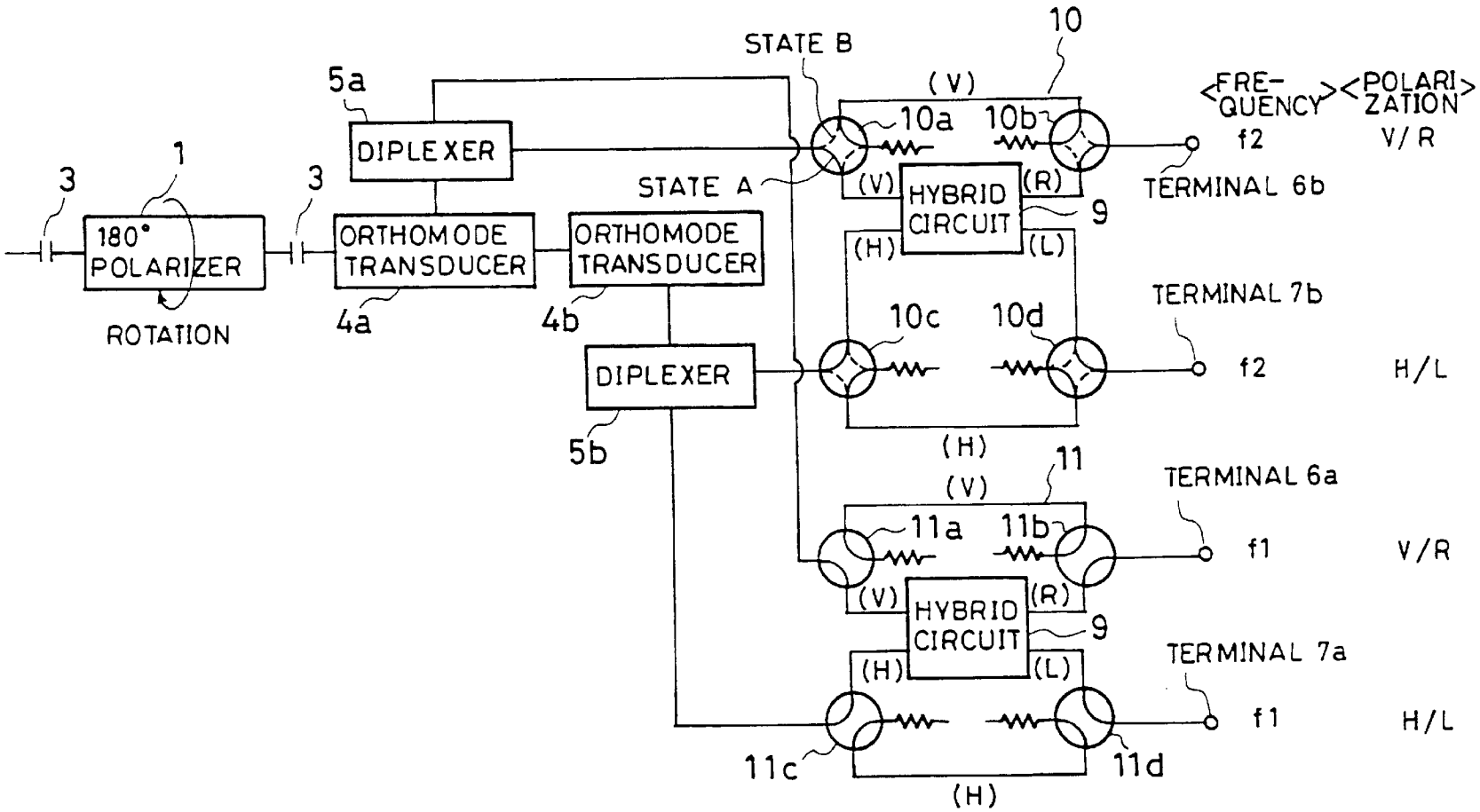
FIG. 5 is a block diagram of antenna feeding system according to the Embodiment 2 of the present invention.

In the antenna feeding system as shown by FIG. 5, in addition to the selector switch 10 for forming path for signal with frequency $f_2$, a further selector switch for signal with frequency $f_1$ is provided so that selector switches for two channels of $f_1$ and $f_2$ are provided and by switching the selector switches 10 and 11, an arbitrary selection of a simultaneous reception mode among the simultaneous reception mode of a circularly polarized wave signal with frequency $f_1$ and the same with frequency $f_2$, mode of a circularly polarized wave signal with frequency $f_1$ and a linearly polarized wave signal with frequency $f_2$, mode of linearly polarized wave signal with frequency $f_1$ and a circularly polarized wave signal with frequency $f_2$ and mode of a linearly polarized wave signal with frequency $f_1$ and the same with frequency $f_2$ is brought to be attainable as shown by FIG. 8(*c*).

Embodiment 3

In the Embodiment 1, description is given on the antenna feeding system enabling reception of a linearly polarized wave signal with frequency $f_1$ and a circularly polarized wave signal with frequency $f_2$ transmitted from a satellite by adapting a hybrid circuit for synthesizing two signals having identical amplitudes by giving a 90° phase shift between them without relying on the 90° polarizer.

Figure 6:
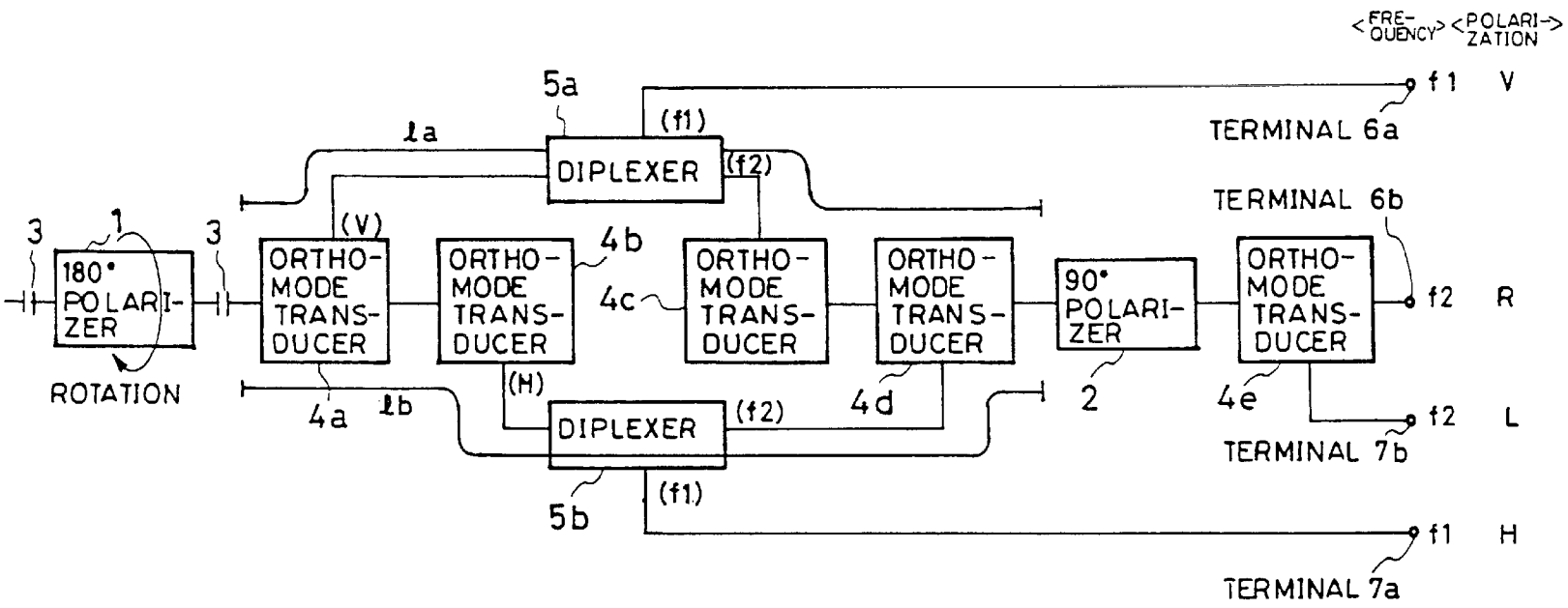
FIG. 6 is a block diagram of antenna feeding system according to the Embodiment 3 of the present invention.
Figure 7:
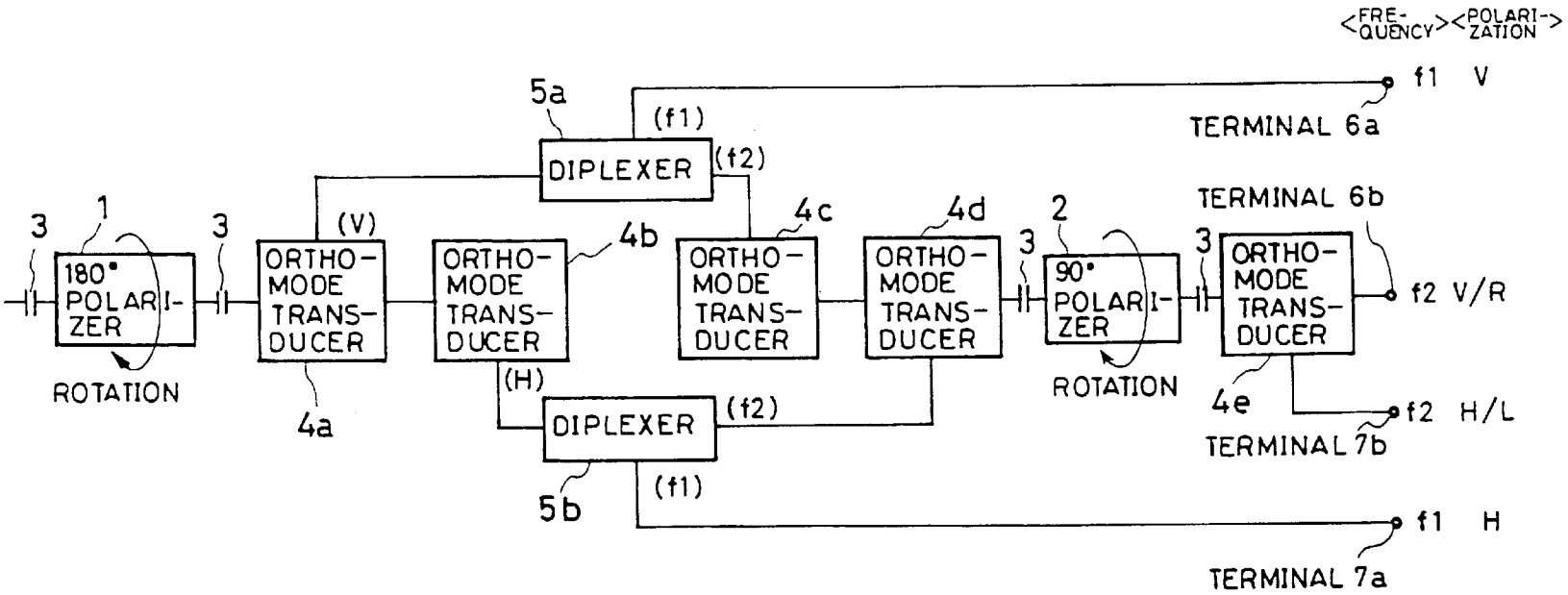
FIG. 7 is a block diagram of antenna feeding system according to the Embodiment 3 of the present invention.

On the other hand, in the Embodiment 3 instead of the hybrid circuit adapted to the antenna feeding system in the Embodiment 1, an orthomode transducers 4*c* and 4*d* carrying out the function serving as the first orthomode transducer for synthesizing signals transmitted from the diplexers 5*a* and 5*b* to form a circularly polarized wave, a 90° polarizer 2 for outputting a vertically polarized wave signal or a horizontally polarized wave signal depending on the circularly polarized signal outputted from the orthomode transducers 4*c* and 4*d* being right handed or left handed respectively, ad an orthomode transducer 4*e* carrying out the function as the second orthomode transducer for outputting a signal to a predetermined terminal depending on the wave signal outputted from the 90° polarizer being vertically polarized or horizontally polarized are disposed. FIG. 6 and FIG. 7 are block diagrams of the antenna feeding system according to the Embodiment 3, and subsequently a description on the operation for reception of a circularly polarized wave signal with frequency $f_2$ will be given. Now the description on reception of a linearly polarized wave signal with frequency $f_1$ is deleted.

The circularly polarized wave signal with frequency $f_2$ is inputted to the orthomode transducers 4*a* and 4*b* through the 180° polarizer 1. The orthomode transducers 4*a* and 4*b* convert the inputted circularly polarized wave signal to a vertically polarized wave V and a horizontally polarized wave H and output them to the diplexers 5*a* and 5*b*, respectively. Since the frequency of the signals inputted to the diplexers 5*a* and 5*b* are $f_2$the vertically polarized wave signal V and the horizontally polarized wave signal H are outputted to the orthomode transducers 4*c* and 4*d*, respectively. Now, those orthomode transducers 4*c* and 4*d* are arranged to be equivalent to orthomodes transducers 4*a* and 4*b*.

The vertically polarized wave signal V and the horizontally polarized wave signal H outputted from diplexers 5*a* and 5*b* are synthesized through the orthomode transducers 4*c* and 4*d* to a circularly polarized wave signal and thus produced circularly polarized wave signal is inputted to the 90° polarizer and it is resolved to orthogonally intersecting two waves of a vertically polarized wave V and a horizontally polarized wave H.

This 90° polarizer 2 resolves the inputted circularly polarized wave to a vertically polarized wave V or a horizontally polarized wave H depending on the circularly polarized wave being right handed or left handed, respectively, and the vertically polarized wave V and the horizontally polarized wave H are outputted to the signal terminal 6*b* and 7*b*, respectively.

As mentioned above, the antenna feeding system according to the Embodiment 3 is provided with the orthomode transducers 4*c* and 4*d*, 90° polarizer 2 and the orthomode transducer 4*e* instead of the hybrid circuit for synthesizing two signals having identical amplitudes with phase angle of 90° shifted. By employing such an arrangement, it is possible to bring the signal path length 1*a* covering the route of orthomode transducers 4*a* and 4*b*/diplexer 5*a*/orthomode transducers 4*c* and 4*d* and the signal path length 1*b* covering the route of orthomode transducer 4*a* and 4*b*/diplexer 5*b*/orthomode transducers 4*c* and 4*d* can be brought to be approximately equal and as a result, the phase difference is kept to be 90° over a wide range of frequency band by virtue of cancellation of frequency characteristics of orthomode transducers 4*a* and 4*c*.

As shown by FIG. 8(*a*), the antenna feeding system according to Embodiment 3 is capable of a simultaneous reception of a linearly polarized wave signal with frequency $f_1$ and a circularly polarized wave signal with frequency $f_2$, and yet as shown by FIG. 7 by providing rotary joints 3 on the input side and the output side of the 90°-polarizer 2 it is also possible to receive a linearly polarized wave signal with frequency $f_1$ and the same with frequency $f_2$ as shown by FIG. 8(*b*). In other words, it is possible to communicate by switching mode of the polarized wave with frequency $f_2$ to a linearly polarized wave or a circularly polarized wave by changing the setting angle of the dielectric plate of the 90° polarizer 2.

Since the antenna feeding system according to the present invention employs an arrangement without relying on a 90° polarizer which is required to change the setting angle depending on the type of polarization, it is possible to carry out a simultaneous transmission and reception of a circularly polarized wave signal and a linearly polarized wave signal. Also, since the hybrid circuit is capable of outputting a signal to a predetermined terminal depending on type of the circularly polarized wave, an appropriate signal can be drawn from a signal terminal allocated depending on frequency and type of polarization of signal.

Also, the antenna feeding system according to the present invention is provided with selector switches for selectively switching destination of signal to be outputted and by switching these selector switches, it is possible arbitrarily choose a mode of receiving a linearly polarized wave signal with frequency $f_1$ and a circularly polarized wave signal with frequency $f_2$ or a mode of receiving a linearly polarized wave signal $f_1$ and the same with frequency $f_2$.

Also, the antenna feeding system according to the present invention is provided with selector switches for two channels for frequency $f_1$ and frequency $f_2$ and by switching those selector switches it is possible to choose arbitrarily the mode of simultaneous reception of a circularly polarized wave signal with frequency $f_1$ and the same with frequency $f_2$, the mode of simultaneous reception of a circularly polarized wave signal with frequency $f_1$ and a linearly polarized wave signal with frequency $f_2$, a mode of simultaneous reception of a linearly polarized wave signal with frequency $f_1$ and a circularly polarized wave signal with frequency $f_2$ or a mode of simultaneous reception of a linearly polarized wave signal with frequency $f_1$ and the same with frequency $f_2$.

The antenna feeding system according to the present invention is provided with phase shifters for compensating the phase difference between the vertically polarized wave and the horizontally polarized wave being inputted. By employing such an arrangement, property of orthognality between these polarized waves is prevent from being deviated and thus signal having a good axes ratio can be drawn always resulting in an improvement of quality of communication.

Also the antenna feeding system is, instead of the hybrid circuit, provided with a first orthomode transducer for synthesizing the orthogonally intersecting linearly polarized wave signals outputted from the diplexers to a circularly polarized wave signal, a 90° diplexer for outputting a vertically polarized wave or a horizontally polarized wave depending on the type of the circularly polarized wave signal outputted from the first orthomode transducer, and a second orthomode transducer for outputting a signal to a predetermined signal depending on the type of the circularly polarized wave.

Consequently, by virtue of canceling the frequency characteristics of the orthomode transducers, the phase difference can be kept to ninety degrees over a wide frequency band.

Also since the antenna feeding system according to the present invention is provided with rotary joints on the input side and output side of the 90° polarizer, it is possible to carrying out communication by switching the polarized wave with frequency $f_2$ to mode of a linearly polarized wave and a circularly polarized wave by changing the setting angle of the 90° polarizer.

What is claimed is:

1. An antenna feeding system comprising:

a plurality of orthomode transducers for resolving a simultaneously received circularly polarized wave signal and a linearly polarized wave signal into a vertically polarized wave signal and a horizontally polarized wave signal and for outputting each of said vertically polarized wave signal and said horizontally polarized wave signal with respect to each polarization;

a first diplexer for dividing said vertically polarized wave signal outputted from one of said orthomode transducers into at least two divided signals with respect to frequency and for outputting a divided vertically polarized wave signal having the same frequency as said circularly polarized wave signal to a signal path, which is allocated to the frequency of said circularly polarized wave signal, and for outputting a divided vertically polarized wave signal having the same frequency as said linearly polarized wave signal to a signal terminal provided for said vertically polarized wave signal, a second diplexer for dividing said horizontally polarized wave signal outputted from one of said orthomode transducers into at least two divided signals with respect to frequency and for outputting a divided horizontally polarized wave signal having the same frequency as said circularly polarized wave signal to a signal path, which is allocated to the frequency of said circularly polarized wave signal, and for outputting a divided horizontally polarized wave signal having the same frequency as said linearly polarized wave signal to a signal terminal provided for said horizontally polarized wave signal, and a hybrid circuit for synthesizing said signals transmitted from said first diplexer and from said second diplexer through said signal paths, which are allocated to the frequency of said circularly polarized wave signal, into a synthesized signal upon imparting a phase difference of ninety degrees between said signals and for outputting said synthesized signal selectively to either of a signal terminal provided for a right-handed circularly polarized wave signal or a signal terminal provided for a left-handed circularly polarized wave signal with respect to a type of said circularly polarized wave signal.

2. An antenna feeding system according to claim 1, wherein selector switches, which perform switching destinations of output signals being divided by said first diplexer and said second diplexer between said hybrid circuit and said signal terminals, are disposed between said diplexers and said hybrid circuit.

3. An antenna feeding system according to claim 2, wherein with respect to said circularly polarized wave signal inputted into said orthomode transducers, said selector switches connect said signal paths being allocated to said frequency of said circularly polarized wave signal to said hybrid circuit so that signals outputted from said first diplexer and from said second diplexer are inputted to said hybrid circuit, and with respect to said linearly polarized wave signal inputted into said orthomode transducers, said selector switches connect said signal paths being allocated to said frequency of said linearly polarized wave to predetermined signal terminals so that signals outputted from said first diplexer and from said second diplexer are inputted to said signal terminals.

4. An antenna feeding system according to claim 1, wherein said hybrid circuit synthesizes signals, which are inputted through phase shifters for compensating phase difference of signals, being divided with respect to frequency by said first diplexer and said second diplexer.

5. An antenna feeding system comprising:

orthomode transducers for resolving simultaneously received circularly polarized wave signal and linearly polarized wave signal into a vertically polarized wave signal and a horizontally polarized wave signal and for outputting each of said vertically polarized wave signal and said horizontally polarized wave signal with respect to each polarization;

a first diplexer for dividing said vertically polarized wave signal outputted from said orthomode transducer with respect to frequency and for outputting said vertically polarized wave signal having the same frequency with that of said circularly polarized wave signal to a signal path, which is allocated for the frequency of said circularly polarized wave signal, and for outputting said vertically polarized wave signal having the same frequency with that of said linearly polarized wave to a signal terminal provided for said vertically polarized wave signal;

a second diplexer for dividing said horizontally polarized wave signal outputted from orthomode transducer with respect to frequency and for outputting said horizontally polarized wave signal having the same frequency with that of said circularly polarized wave signal to a signal path, which is allocated to the frequency of said circularly polarized wave signal, and for outputting said horizontally polarized wave signal having the same frequency with that of said linearly polarized wave signal to a signal terminal provided for said horizontally polarized wave signal, and first orthomode transducers being connected to said first diplexer and to said second diplexer through said signal paths being allocated to the frequency of said circularly polarized wave signal and for synthesizing said signals, which are transmitted through said paths from said diplexers, to a circularly polarized wave signal terminal;

a first 90° polarizer for outputting a vertically polarized wave signal when said circularly polarized signal transmitted from said first orthomode transducers is right-handed, and for outputting a horizontally polarized wave signal when said circularly polarized wave signal transmitted from said first orthomode transducers is left-handed, and a second orthomode transducer for outputting a signal to a predetermined signal terminal depending on wave signal outputted from said 90° polarizer being vertically polarized or being horizontally polarized.

* * * * *

UNITED STATES PATENT AND TRADEMARK OFFICE

CERTIFICATE OF CORRECTION

PATENT NO. : 6,388,537 B1
DATED : May 14, 2002
INVENTOR(S) : Soichi Matsumoto

It is certified that error appears in the above-identified patent and that said Letters Patent is hereby corrected as shown below:

Column 2,
Line 63, "angle a" should be -- angle α --.
Line 65, "angle of a" should be -- angle of α --.

Column 6,
Line 67, "1800" should be -- 180º --.

Column 7,
Line 10, "polarizer i" should be -- polarizer 1 --.

Column 10,
Line 34, after "$f_2$" insert a comma -- , --.

Signed and Sealed this

Eighteenth Day of March, 2003

JAMES E. ROGAN
*Director of the United States Patent and Trademark Office*